US008986057B2

(12) United States Patent
Catarina

(10) Patent No.: US 8,986,057 B2
(45) Date of Patent: Mar. 24, 2015

(54) BOAT THAT CAN BE CONVERTED INTO A GYMNASTICS APPARATUS

(76) Inventor: Mateus Frois Santa Catarina, Rio de Janeiro-RJ (BR)

( * ) Notice: Subject to any disclaimer, the term of this patent is extended or adjusted under 35 U.S.C. 154(b) by 116 days.

(21) Appl. No.: 13/817,534

(22) PCT Filed: Aug. 17, 2011

(86) PCT No.: PCT/BR2011/000286

§ 371 (c)(1),
(2), (4) Date: Feb. 18, 2013

(87) PCT Pub. No.: WO2012/021954

PCT Pub. Date: Feb. 23, 2012

(65) Prior Publication Data

US 2013/0157529 A1 Jun. 20, 2013

(30) Foreign Application Priority Data

Aug. 20, 2010 (BR) ..... 1002941

(51) Int. Cl.

| | |
|---|---|
| ***B63H 16/18*** | (2006.01) |
| ***B63B 1/12*** | (2006.01) |
| ***B63B 7/02*** | (2006.01) |
| ***B63H 16/08*** | (2006.01) |
| ***A63B 22/04*** | (2006.01) |
| ***B63H 25/10*** | (2006.01) |

(52) U.S. Cl.

CPC *B63H 16/18* (2013.01); *B63B 1/12* (2013.01); *B63B 7/02* (2013.01); *B63H 16/12* (2013.01); *A63B 22/04* (2013.01); *B63H 25/10* (2013.01)

USPC ..... 440/21

(58) Field of Classification Search

USPC ..... 440/21, 27, 30; 482/52; 114/162

See application file for complete search history.

(56) References Cited

U.S. PATENT DOCUMENTS 1,761,883 A * 6/1930 Froedtert ..... 440/30
5,718,611 A * 2/1998 Schlangen et al. ..... 440/27

* cited by examiner

*Primary Examiner* — Lars A Olson

(57) ABSTRACT

The present invention relates to a boat propelled by two submerged independent wings actuated by means of a step simulator mechanism that imparts an vertical alternating movement to the wings, which are articulated around a shaft located forward of the center of pressure thereof, such that the wings assume angles of inclination that generates propulsive force in the upward and downward movements. In the analogous position of a conventional bicycle, the driver actuates the footrests while seated. A handlebar, connected to a rudder, is used to maneuver the vehicle. The catamaran configuration offers hydrodynamic efficiency and stability. When disassembled, the mainframe of the boat can be converted into a step machine, simply fitting a pair of dampers to the structure, which absorb and dissipate the energy generated during exercising. Thus, the present invention has a dual use—boat and gymnastics apparatus—and can be transported in the car trunk.

9 Claims, 9 Drawing Sheets

BOAT THAT CAN BE CONVERTED INTO A GYMNASTICS APPARATUS

CROSS-REFERENCE TO RELATED APPLICATIONS

The present application claims the benefits of PCT/BR2011/000286, filed on Aug. 17, 2011, and Brazilian Application BR No. PI1002941-9, filed on Aug. 20, 2010, both of which are entitled "BARCO QUE SE CONVERTE EM APARELHO DE GINÁSTICA" translated here to "BOAT THAT CAN BE CONVERTED INTO A GYMNASTICS APPARATUS", and are incorporated herein by reference in their entireties.

FIELD OF THE INVENTION

The present invention relates to the field of small boats and the field of gymnastics apparatus.

SUMMARY OF THE INVENTION

The present invention relates to a boat propelled by two submerged independent wings 6 actuated by means of a step simulator mechanism that imparts an vertical alternating movement to the wings 6, which are articulated around a shaft located forward of the center of pressure thereof, such that the wings 6 assume angles of inclination that generates propulsive force in the upward and downward movements. The driver assumes an analogous position to that of a conventional bicycle and can actuate the footrests 4 while remaining seated on a bicycle seat 14. In order to maneuver the vehicle, a handlebar 13 is used, which is securely connected to a rudder 12. The boat has a catamaran configuration, which offers hydrodynamic efficiency and stability. When disassembled, the mainframe 1 of the boat can be converted into a step machine (gymnastics apparatus) for residential use. For this finality, it suffices fitting a pair of dampers 15 to the structure. These dampers 15 absorb and dissipate the energy generated during exercising. Thus, the present invention has a dual use, both as a boat and as gymnastics apparatus, and can be transported in the trunk of an automobile.

Up to now, there are no reports of boats that have been designed for use as home fitness equipment. The present invention brings novelty both in the field of small boats as in the field of fitness equipment.

In the field of small watercrafts there are U.S. Pat. No. 6,099,369 and U.S. Pat. No. 7,021,232 B2, which respectively refer to the products marketed under the brand Pumpabike and Aquaskipper. Both have a similar configuration and are propelled by a system of vertical reciprocating movement of the main wing (flapping wing propulsion), which is very efficient, allowing these watercrafts to reach high speed. Such watercrafts have no flotation device, while the main wing serves both for propulsion and for support. The drawback of these two inventions is that, due to the absence of flotation device, when the driver stop exciting the oscillatory movements with his feet, the watercraft sinks. Another disadvantage is that it requires a suitable technique to work and there is, therefore, a learning period until the person gets skilled in the art.

The present invention has no learning curve. It uses a catamaran type flotation device and wings that are used exclusively for propulsion. Two independent sidebars are mounted on a predominantly horizontal position and articulated to the mainframe. The sidebars articulate relative to a front axle, similarly as occurs with most of step machine fitness equipment, and have footrest located in the intermediate position of the sidebars. In the rear position of the sidebars, a rope links both, passing through a pulley, which is in a higher position. Thus, when one of the sidebars goes down, the other goes up. In the rear position of each bar, a propulsive rod is fixed perpendicularly, which extends downwardly so that its lower edge is constantly submerged. At the lower edge of each propulsive rod there is a wing which has a freedom of movement limited by stops, so that when the wing is doing a downward movement, the wing assumes a negative rake angle, so that it generates lift having a component in the direction of motion of the boat. At the same moment the other wing will be performing an upward movement, and assuming a positive rake angle, so that it also generates lift having a component in the direction of motion of the boat. As the wings have a symmetrical profile, the vertical component of the lift of each wing will have intensity equal and opposite to the other wing. Thus the horizontal components add up (propulsive force) and vertical components cancel each other.

The cancellation of vertical forces is important because there is no vertical oscillation movement transmitted to the boat, allowing the floats move smoothly, making the ride more enjoyable for the user. As each wing is separated laterally, its vertical lift components, which have equal intensity and opposite direction, forms a torque which tends to rotate the boat relative to its longitudinal axis thereof, oscillating between one direction of rotation and the other. This oscillating torque is cancelled by the torque, also oscillating in the same frequency, caused by the natural movement of the driver, which applies force alternating the left and right leg.

Thus there is no rotation movement about the longitudinal axis transmitted to the boat, which slides smoothly and efficiently, reaching high speeds. So we have a simple, robust, reliable and highly hydrodynamic efficient propulsive system. In the central part of the main structure there is a column predominantly vertical and directed upwardly. It has a dual function, serving as a support for the pulley and also for fixing the seat (same type used in conventional bicycles). At the front of the mainframe near the pivot axis of the sidebars, a steering shaft is mounted pivotally in relation to its axis and in a predominantly vertical position. In the top position of this steering shaft a handlebar (same type used in conventional bicycles) is fixed and at the bottom, a rudder. This type of guidance system is public domain because it was already used in other patents that has expired, as is the case of U.S. Pat. No. 1,761,883, and so, it is not subject to claim. The same system is used in U.S. Pat. No. 5,405,275 and U.S. Pat. No. 5,718,611, which refers to the product marketed under the brand Hydrobike, and it is a simple and efficient guidance system.

Removing the floats, the rudder and the connecting bars, we have the mainframe of the boat. Adding a pair of dampers on the lower of sidebars, we have a step machine (gymnastics apparatus). This device brings some novelty regarding to the current state of the art, because it allows the person to workout in a seated position, as occurs in conventional bikes. Alternatively one can workout in a stand up position as with the existing models, but have the option to sit down. The handlebar provides support for the person to maintain balance more easily. The other novelty is the mode of binding of the sidebars through a rope passing through a pulley in a rearward position, away from the pivot axis, where efforts are smaller. The step machine of current state of the art are often linked in a region close to the pivot axis of sidebars, which requires higher forces (since the arm is shorter), subjecting the structure to cyclic stresses that tend to fatigued material, which may lead to early failure of the structure. Thus, the present invention provides, in addition to the boat, a simple and robust step machine, which brings novelty regarding the current state of the art and can be used as an exercise device for residential use, which increases the usefulness of invention.

One major advantage of the present invention is simplicity. The vast majority of small human powered boats use pedal and propeller for propulsion. These systems involve transmission mechanisms consisting of gears, shafts, chains, bearings, seals etc. Usually, if one of these components fails, it represents a failure of the system as a whole, since the same cannot satisfactorily perform its function. The larger the amount of system components, the greater the number of possible failure modes, the maintenance is more complicated, the greater is the cost of the final product. The present invention uses a small number of components, being constituted only by levers and pulley, systems that are mechanically simple and robust. Thus the present invention is resistant to failures, simple maintenance and low cost. Besides these advantages, this propulsion system is as efficient as those pedal and propeller. To lower the cost of the product, the present invention proposes the use of bicycle parts such as the seat, handlebars and quick release mechanisms, which are easy to purchase and have a low cost. Therefore the present invention combines the basic components for a successful product: utility, simplicity, efficiency and low cost.

The boat may be configured to be used by two occupants and for that, two main structures are joined side by side by two connecting rods, which have in its middle part a support to attach an additional float. Thus we have a trimaran boat for two occupants.

The present invention, by having an easy and intuitive operation, aims to offer a sport and leisure alternative to anyone, not requiring specific skills. The invention encompasses all age groups, analogously to bicycles, with the advantage of not requiring balance. Reduced scale models can be made for children.

Due to the detachable characteristics, the present invention can be transported in the trunk of a car. The compact size associated with low weight decreases the costs associated with transporting the goods, being an ideal product for marketing via internet.

BRIEF DESCRIPTION OF THE DRAWINGS

The preferred embodiments of the present invention will now be described, by way of a non-limiting example of the invention, with reference to the attached drawings. In the drawings.

DETAILED DESCRIPTION OF THE INVENTION

Figure 1:
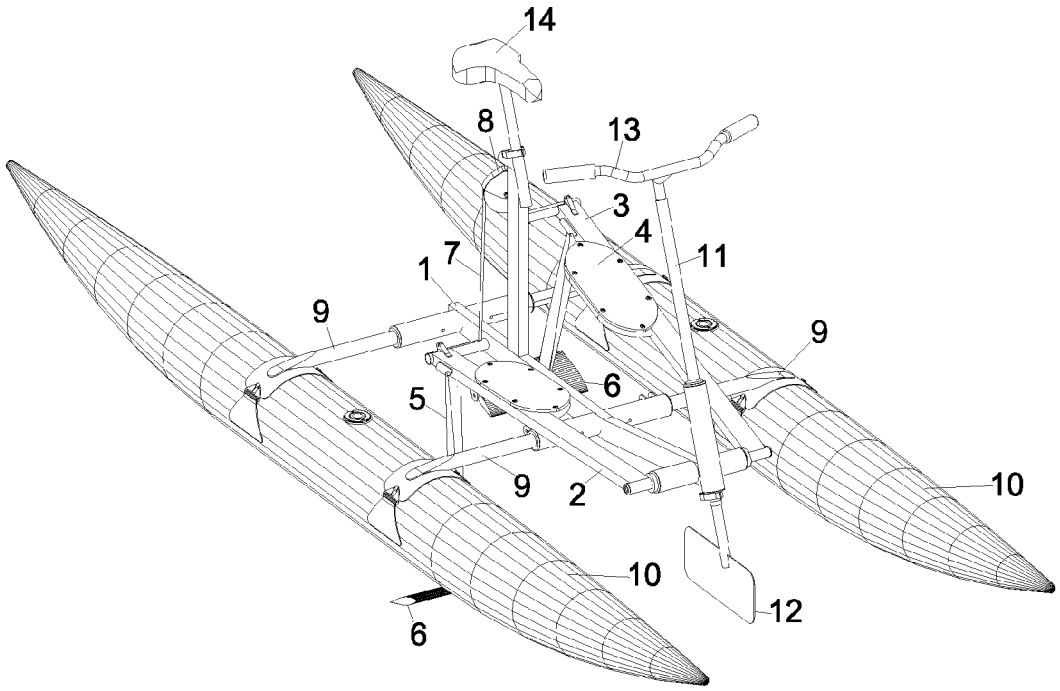
FIG. 1 is a perspective view of a boat that can be converted into a gymnastics apparatus according to the present invention.

FIG. 1 shows a perspective view of a boat that can be converted into a gymnastics apparatus according to the present invention. The boat consists basically of a mainframe 1 on which are mounted the elements. The sidebars 2 and 3 are mounted in an articulated manner on the sides of the mainframe 1. Footrest 4 is fixed on its intermediate position. In the rear position is fixed the propulsive rod 5, at the end of which, in a submerged position, the wing 6 is mounted. A string 7 binds the sidebars 2 and 3, passing through the pulley 8. Four connecting bars 9 connect the mainframe 1 to the floats 10. At the front of the mainframe 1 is mounted the steering shaft 11, and on its lower end, the rudder 12 is fixed. At the upper end of the steering shaft 11 is fixed a handlebar 13, which is linked to the rudder 12, allowing the driver to maneuver the vehicle. The rider sits on a seat 14 which is fixed to the mainframe 1.

Figure 2:
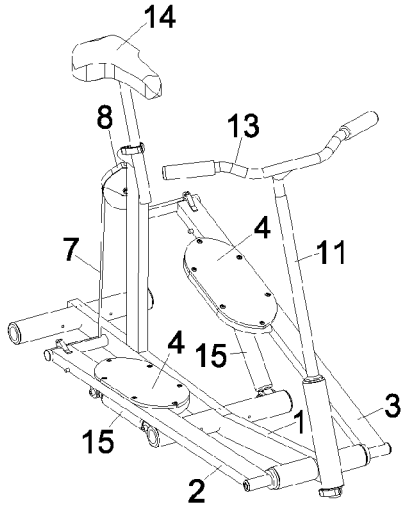
FIG. 2 is a perspective view of a step machine (gymnastics apparatus) according to a boat that can be converted into a gymnastics apparatus according to the present invention.

FIG. 2 shows the step machine (gymnastics apparatus). It is configured by withdrawing the propulsive rods 5, the floats 10, the connecting bars 9, the rudder 12 and by adding the dampers 15.

Figure 3:
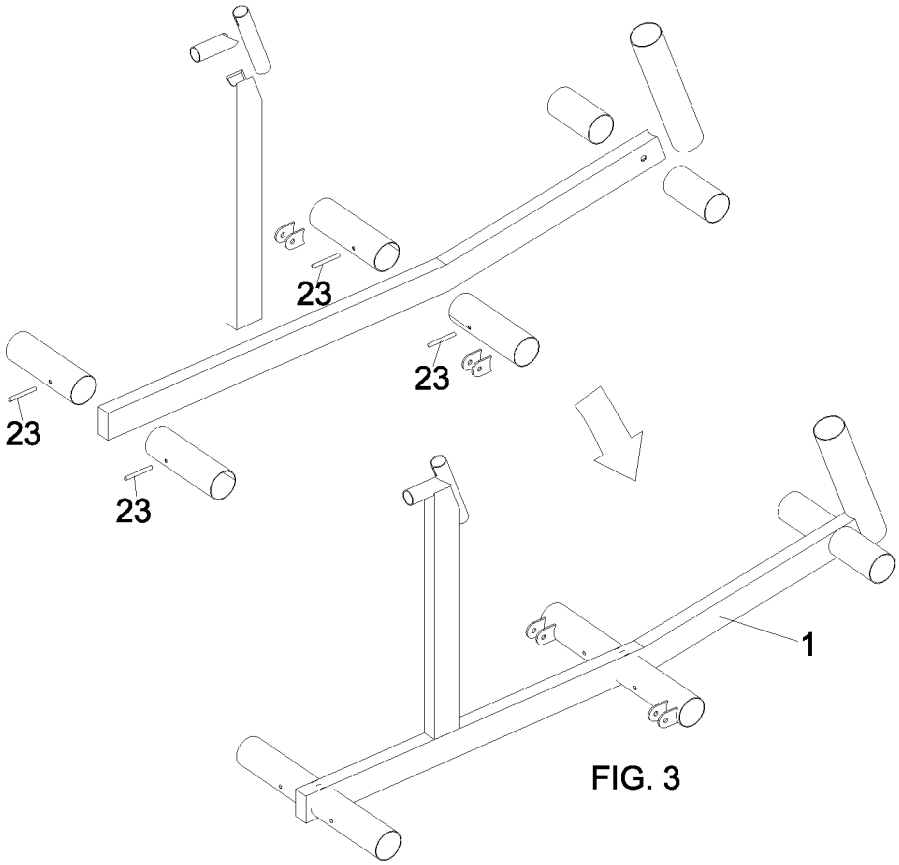
FIG. 3 is made up of figures showing the details of the mainframe of a boat that can be converted into a gymnastics apparatus according to the present invention.
Figure 4:
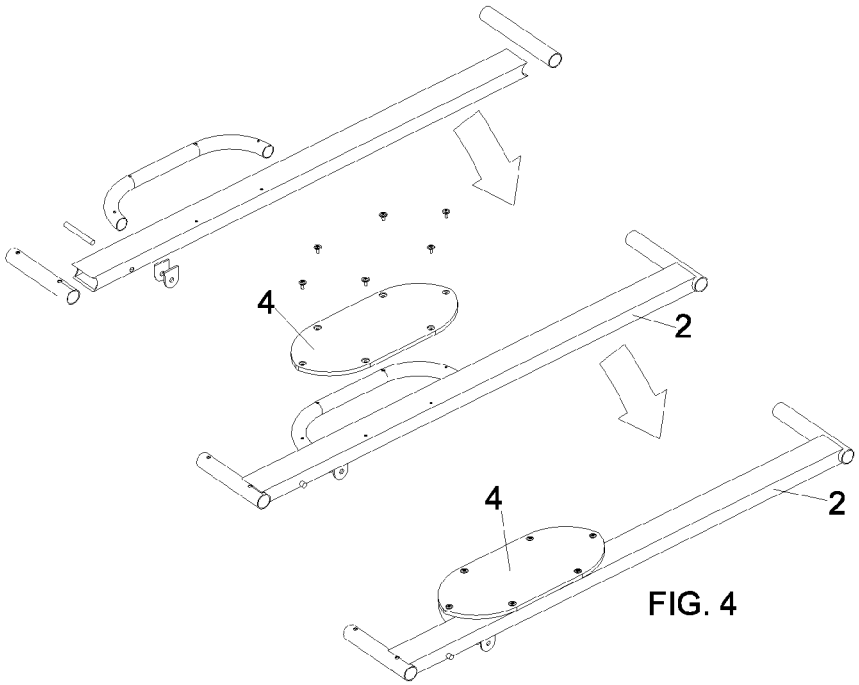
FIG. 4 is made up of four figures showing the details of the right sidebar of a boat that can be converted into a gymnastics apparatus according to the present invention.
Figure 5:
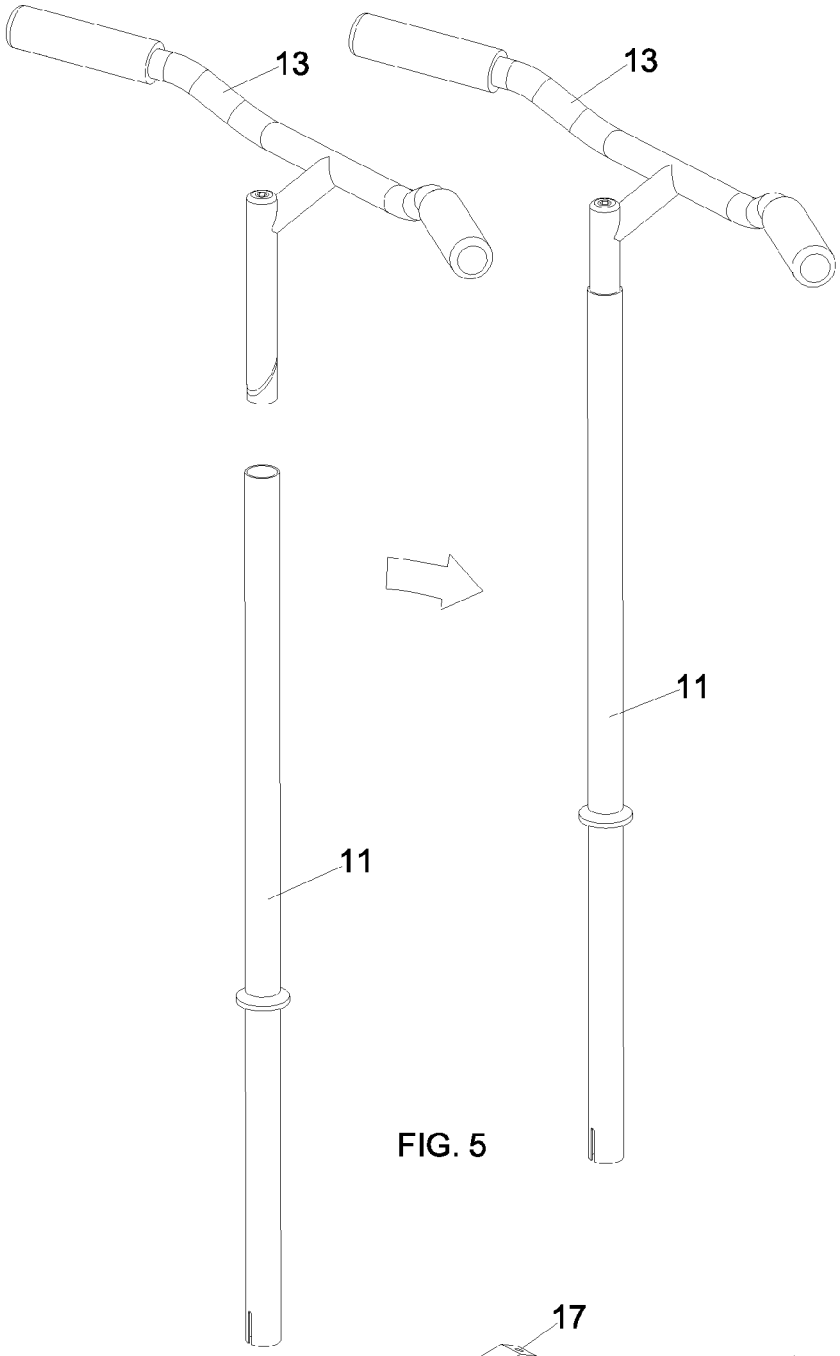
FIG. 5 is made up of figures that show the details of fastening the handlebar in the steering shaft of a boat that can be converted into a gymnastics apparatus according to the present invention.
Figure 6:
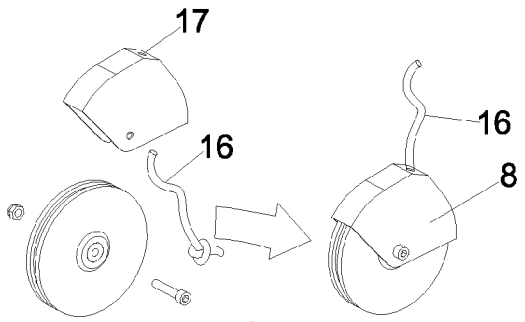
FIG. 6 is made up of figures showing the details of a pulley of a boat that can be converted into a gymnastics apparatus according to the present invention.
Figure 7:
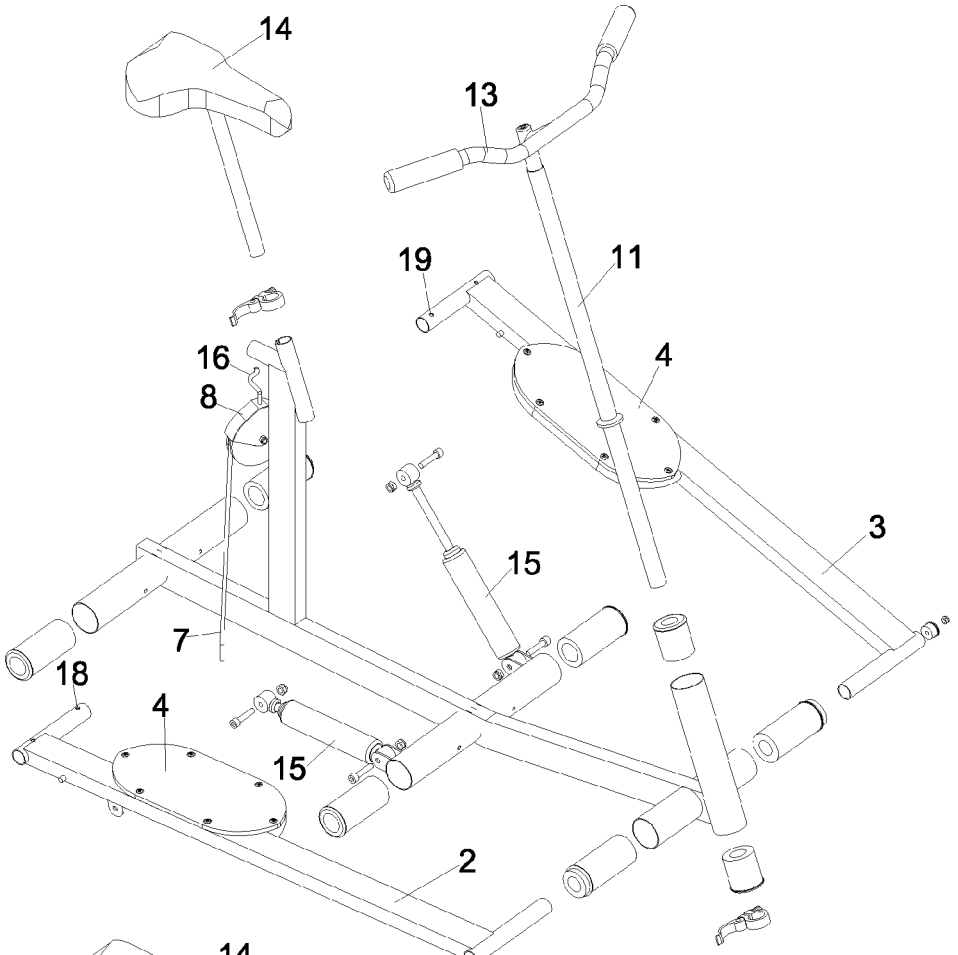
FIG. 7 is an exploded perspective view of a step machine (gymnastics apparatus) according to a boat that can be converted into a gymnastics apparatus according to the present invention.
Figure 8:
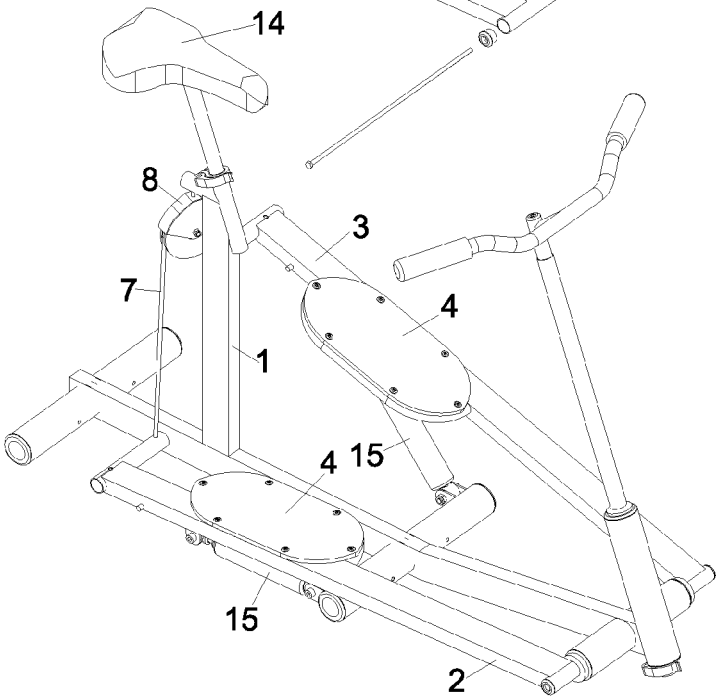
FIG. 8 is a perspective view of a step machine (gymnastics apparatus) according to a boat that can be converted into a gymnastics apparatus according to the present invention.

Following will be presented simple alternatives for manufacturing and assembly of the components as well as an explanation of the operation of the step machine (gymnastics apparatus) according to the present invention. FIG. 3 shows a view of the mainframe 1. It can be made by welding of parts that appear in exploded view. FIG. 4 shows a view of the right sidebar 2. It can be made by welding of parts that appear on the first exploded view. After that, the set receives the footrest 4 which can be riveted or screwed. FIG. 5 shows a view of the steering shaft 11 and fastening the handlebar 13, the same type used in conventional bicycles. FIG. 6 shows a view of the pulley 8. We can see the detail of the fixing of the string 16, which has a knot at one end. The end of string 16 without the knot is passed through the hole 17, until the knot itself abuts, so fixing the string 16 to the pulley 8 in a simple and effective manner. FIG. 7 shows an exploded view of the step machine (gymnastics apparatus). The string 16 is inserted into a hole (not visible in the view) located at the bottom of a tubular holder comprising the mainframe 1. Following, there is a knot in the string 16, which will stop in the hole, so binding the pulley 8 and mainframe 1 in a simple and effective way. After the sidebars are mounted, as suggested in FIG. 7, these are linked through the string 7, passing through the pulley 8. For this purpose, one end of the string 7 is introduced into the hole 18 and the other in the hole 19. Following, a knot is made at each end of the string 7 which will stop at the holes, connecting simply and effectively the sidebars 2 and 3. A pair of dampers 15 is mounted in the set, as shown in FIG. 7, which has the function to absorb and dissipate the energy generated during exercise. FIG. 8 shows the assembled set for comparison. The application of force with the left foot will make the sidebar 3 go down, which make tighten the damper 15 attached to it while the sidebar 2 will rise up, that consequently will extend the damper 15 connected to it and vice versa.

Figure 9:
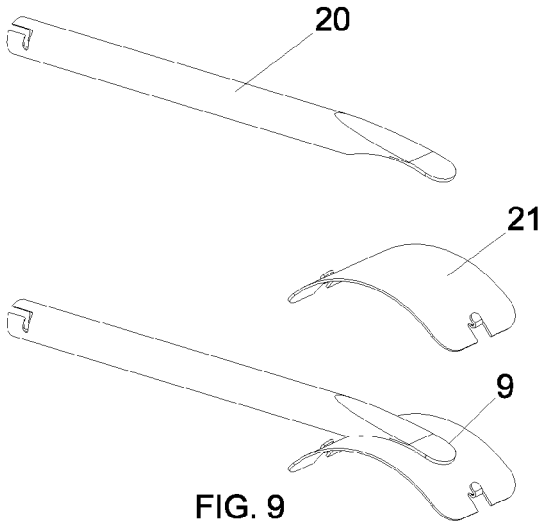
FIG. 9 is made up of figures showing the details of the connecting bar of a boat that can be converted into a gymnastics apparatus according to the present invention.
Figure 10:
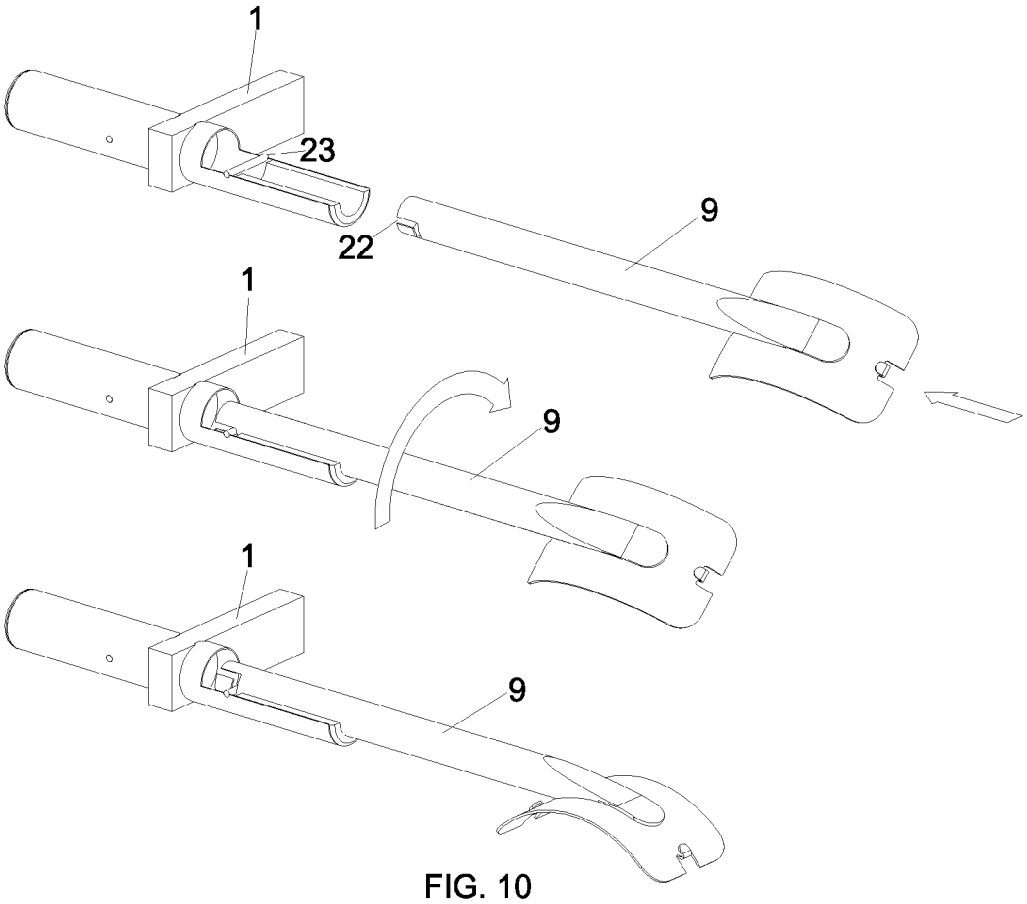
FIG. 10 is made up of figures showing the details of the mechanism for fixing the connecting bar to the main structure of a boat that can be converted into a gymnastics apparatus according to the present invention.
Figure 11:
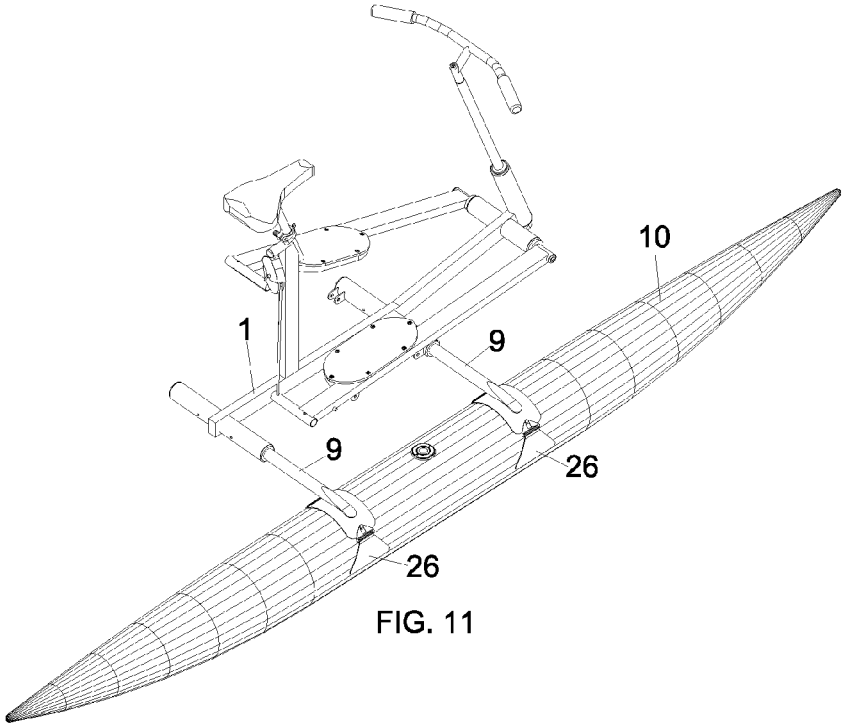
FIG. 11 is a perspective view showing a float attached, by two connecting bars, to the main structure of a boat that can be converted into a gymnastics apparatus according to the present invention.
Figure 12:
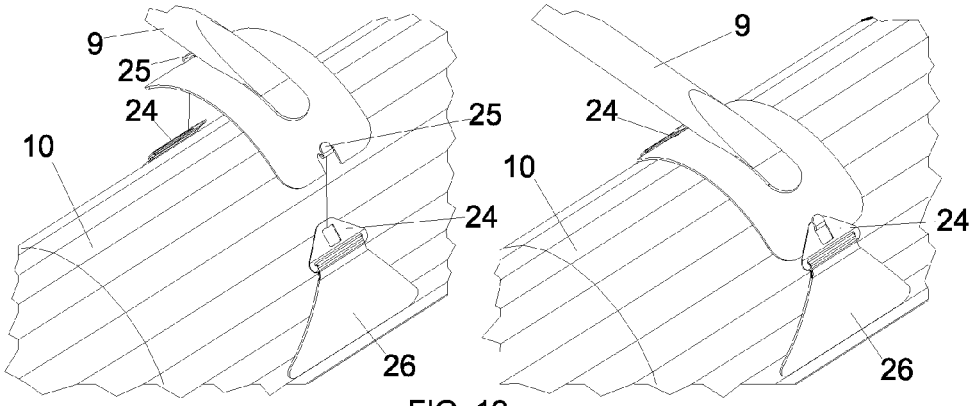
FIG. 12 is made up of figures showing the details of the mechanism for fixing the float to the connecting bar of a boat that can be converted into a gymnastics apparatus according to the present invention.
Figure 13:
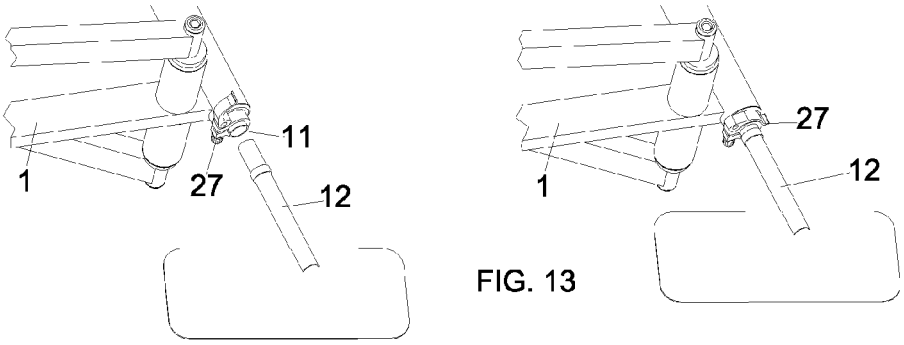
FIG. 13 is made up of figures showing the details of mounting a rudder to the steering shaft of a boat that can be converted into a gymnastics apparatus according to the present invention.

Simple alternatives for manufacturing and assembly of the components and explanations about the operating principle of the boat according to the present invention are following. FIG. 9 shows the connecting bars 9 which are used to connect the mainframe 1 with the floats 10. The connecting bars 9 can be obtained by joining, by rivets or welding of the tube 20 (which is slotted on one side and mechanically formed on the other side, as shown in FIG. 9) to the plate 21. FIG. 10 shows the mechanism for engaging the connecting bars 9 to the mainframe 1 (shown partially in section). First, the connecting bar 9 is inserted so that the notches 22 are aligned to the pin 23 present in the mainframe 1. After that, the connecting bar 9 is turned to the docking position on the float 10. In this position the notch 22 is fitted on the pin 23, which restricts axial movement between the connecting bars 9 and the mainframe 1. With the engagement of the float 10, as shown in FIG. 11, the radial movement of the connecting bars 9 relative to the mainframe 1 is also constrained, thus fixing the parts in a simple and effective way. FIG. 12 shows the detail of how the connecting bars 9 are fixed to the float 10. The procedure consists in fitting the fixing buckles 24 into hooks 25 present on the connecting bars 9. This operation must be performed with the floats 10 in the semi-inflated condition. After performing this operation, the floats 10 must be fully inflated, causing the belts 26 always remain tensioned due to the expansion thereof, ensuring fixation. For removal one should proceed in reverse. FIG. 13 shows the detail of the mounting of the rudder 12. For assembling, just inserting it in the steering shaft 11 and then actuate the quick release mechanism 27. Thus the rudder 12 will be connected to the steering shaft 11.

Figure 14:
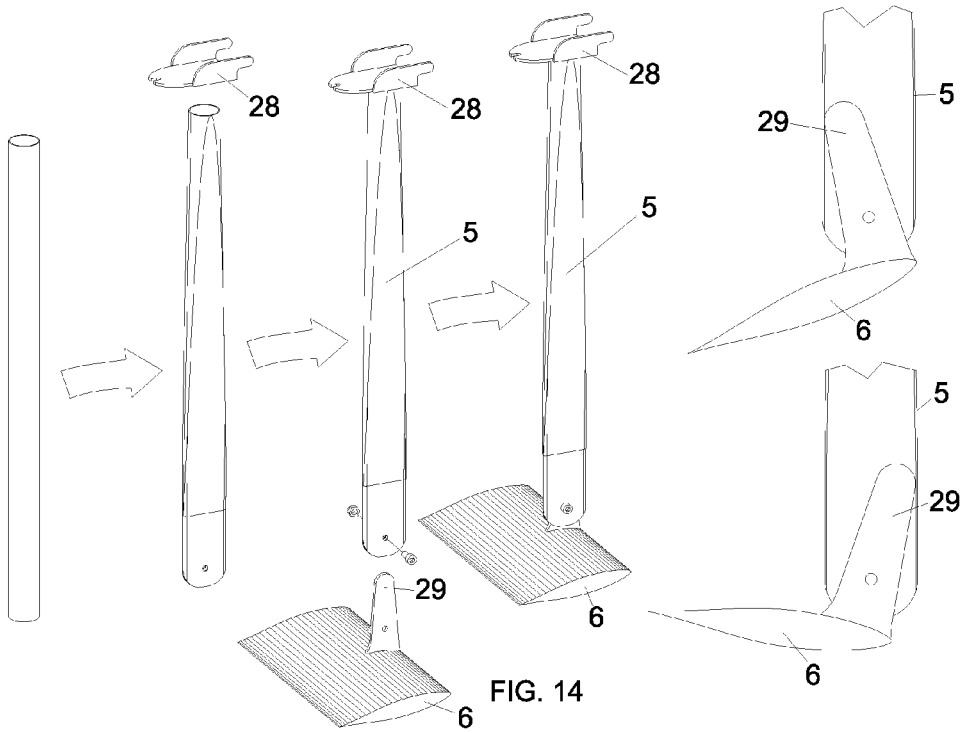
FIG. 14 is made up of figures showing the details of mounting and functioning of a propulsive rod of a boat that can be converted into a gymnastics apparatus according to the present invention.
Figure 15:
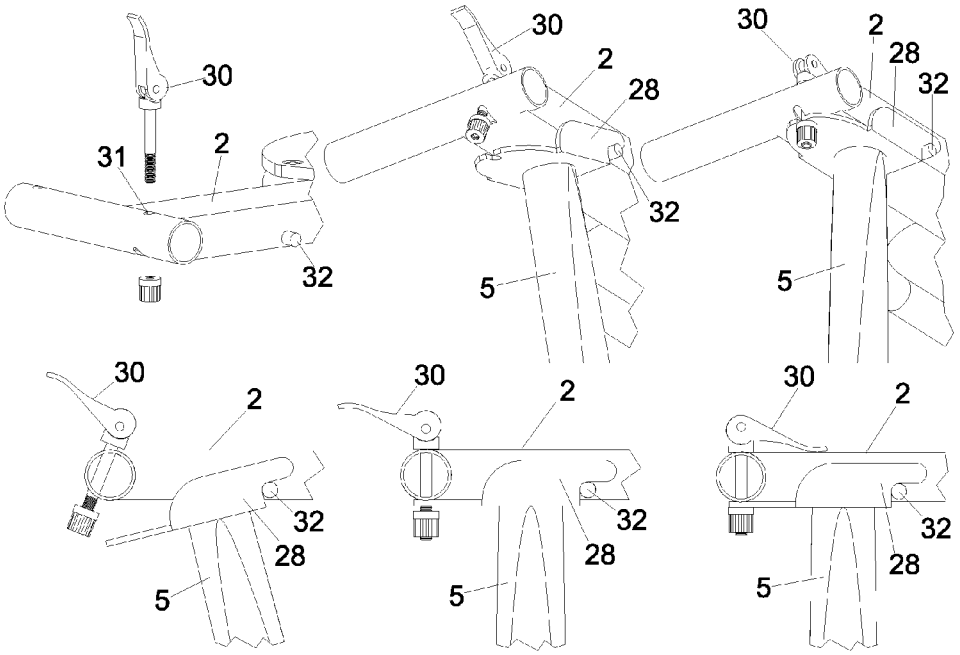
FIG. 15 is made up of figures showing a method of attachment, using quick release mechanism, of a propulsive rod to the sidebar of a boat that can be converted into a gymnastics apparatus according to the present invention.
Figure 16:
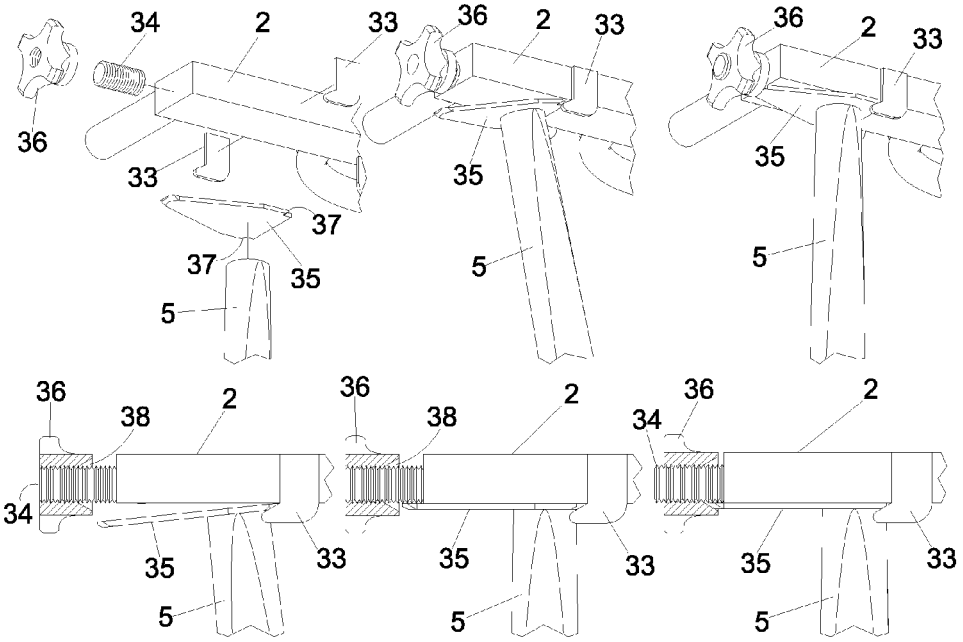
FIG. 16 is made up of figures showing a method of attachment, using threaded shaft and a knob with an internal conical region, of a propulsive rod to the sidebar of a boat that can be converted into a gymnastics apparatus according to the present invention.

FIG. 14 shows how the propulsive rod 5 can be manufactured and assembled. It starts with a tube that is mechanically formed, receiving a drilling hole on its bottom and, by welding, a fitting plate 28 on top. Subsequently the wing 6 is mounted on the propulsive rod 5 as shown. The wing 6 has limited freedom of rotation. The end of the mounting bracket 29 stops at the walls of the tube, as shown in the sectional detail of FIG. 14. The boat has two propulsive rods 5, which are interchangeable and fixed one on each sidebar 2 and 3. Following are two ways of fixing. FIG. 15 shows one way, using quick release mechanism. Initially, the quick release mechanism 30 is inserted into the hole 31 present at the rear end of the sidebar 2. Following, the propulsive rod 5 is positioned so that the engaging side of the fitting plate 28 is fitted into the pin 32 present on the sidebar 2. Finally the propulsive rod 5 is positioned at 90° to the sidebar 2 and the quick release mechanism 30 is triggered, which holds and compresses the rear portion of the fitting plate 28 against the lower wall of the sidebar 2. This mechanism secures the fitting plate 28 at three positions, in the two regions of contact with the pin 32 and in the region set by the quick release mechanism 30. These three positions define a triangle, ensuring an effective setting. FIG. 16 shows a method of attachment which utilizes screw and wedge. To this, two plates 33 and a threaded shaft 34 are joined by soldering to the rear end of the sidebar 2. The fitting plate 35 is joined by welding to the upper end of the propulsive rod 5. Said pieces are positioned as indicated by the lines making up the exploded view in FIG. 16. A knob 36 is screwed into the threaded shaft 34. First, to fix, position the propulsive rod 5, so that the notches 37 in the fitting plate 35 are positioned in the wedge formed by the plates 33 and lower wall of sidebar 2. Subsequently the knob 36 is screwed, pushing the fitting plate 35 against the wedges and fixing firmly the parts. In the three side views that make up the FIG. 16 is shown the sequence of events. The knob 36 appears in section on it, showing the internal conical region 38 which engages and secures the rear portion of the fitting plate 35. The internal conical region 38 also forms a sort of wedge. Therefore, the fitting plate 35 is fixed in three positions by the principle of wedge which compresses the fitting plate 35 against the bottom wall of the sidebar 2. These three fixing positions define a triangle and guarantee an effective fixing.

Figure 17:
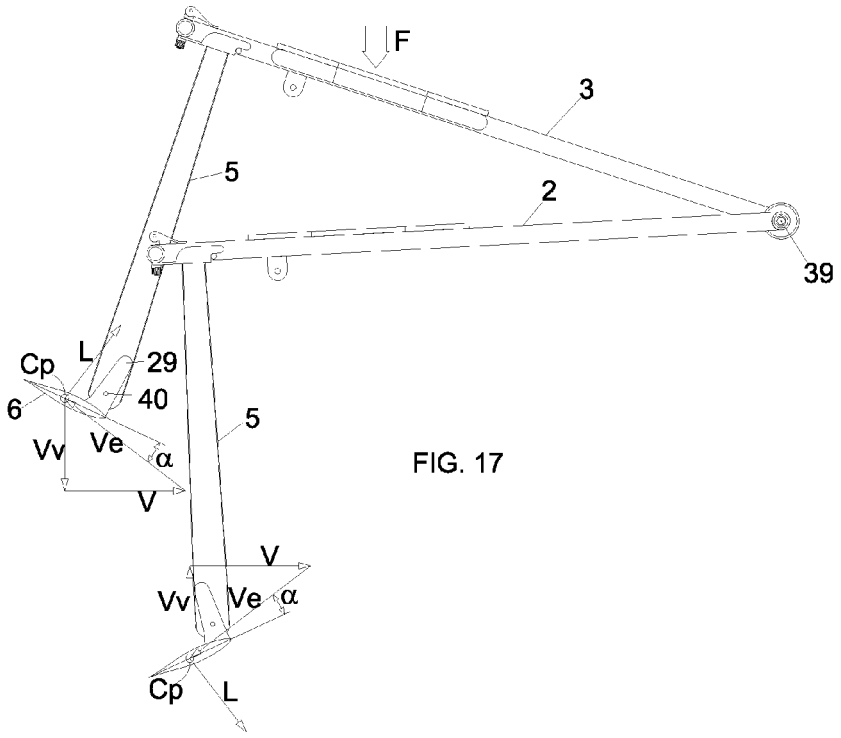
FIG. 17 shows a side view of some components which elucidates the principle of operation of the propulsion system of a boat that can be converted into a gymnastics apparatus according to the present invention.

The principle of operation of the propulsion system of the boat is shown in a simplified manner in FIG. 17. In this figure, parts of the boat are omitted for clarity of the drawing. The occupant are pressing the sidebar 3 with a force F, which rotates the hinge shaft 39, thus printing a speed Vv on wing 6 attached to it. The boat moves at a speed V. The flow velocity relative to the wing 6 is Ve and is at an angle of attack $\alpha$. The flow velocity Ve create a lift force L which acts at the center of pressure Cp of the wing 6.

As the Cp is located behind the pivot center 40, the lift L causes a torque relative to the pivot center 40 which is canceled by the contact of the mounting bracket 29 against the inner wall of the propulsive rod 5. This condition keeps the wing 6 positioned according to FIG. 17. As the sidebar 3 is linked to the sidebar 2 (the link via string and pulley was omitted), it rotates in the opposite direction, but with the same intensity. Therefore the wing connected to the sidebars 2 rises with a speed Vv. The remainder of the explanation is analogous to the previous case, being omitted. As the wings have a symmetrical profile, lift force L of one wing will have intensity equal to that of the other wing. Thus, as shown in FIG. 17, the horizontal components of lift L are added (propulsive force) and vertical components are canceled. The above explanations about the working principle are not accurate from the standpoint of physical and mathematical to avoid complex trigonometric functions and formulas that could hinder understanding.

Figure 18:
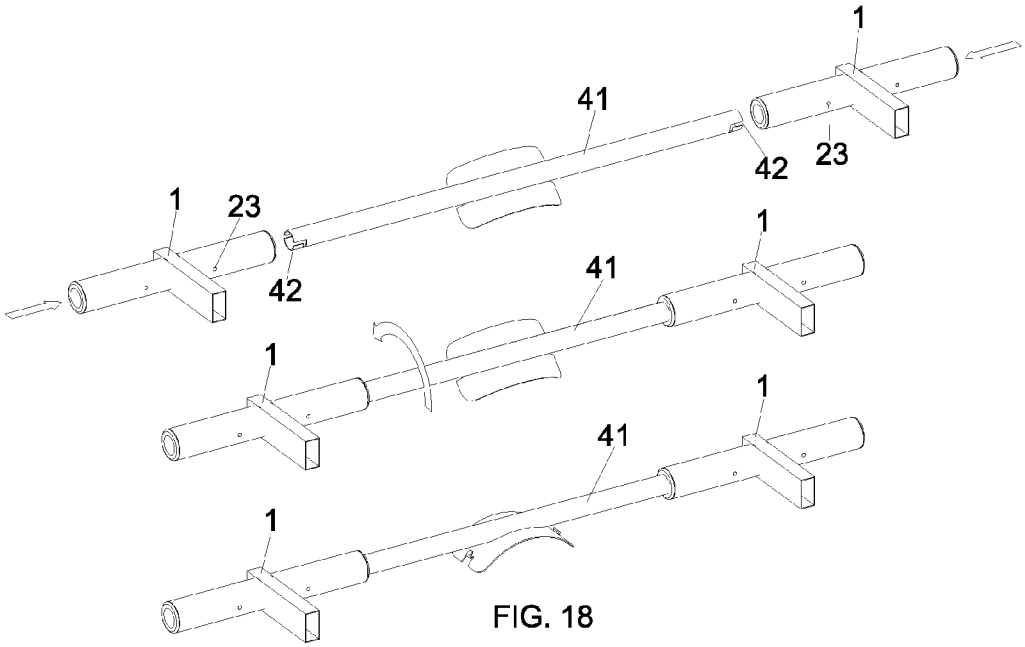
FIG. 18 is made up of figures showing the details of the fixing mechanism of a connecting bar to the main structure of a boat that can be converted into a gymnastics apparatus according to the present invention.
Figure 19:
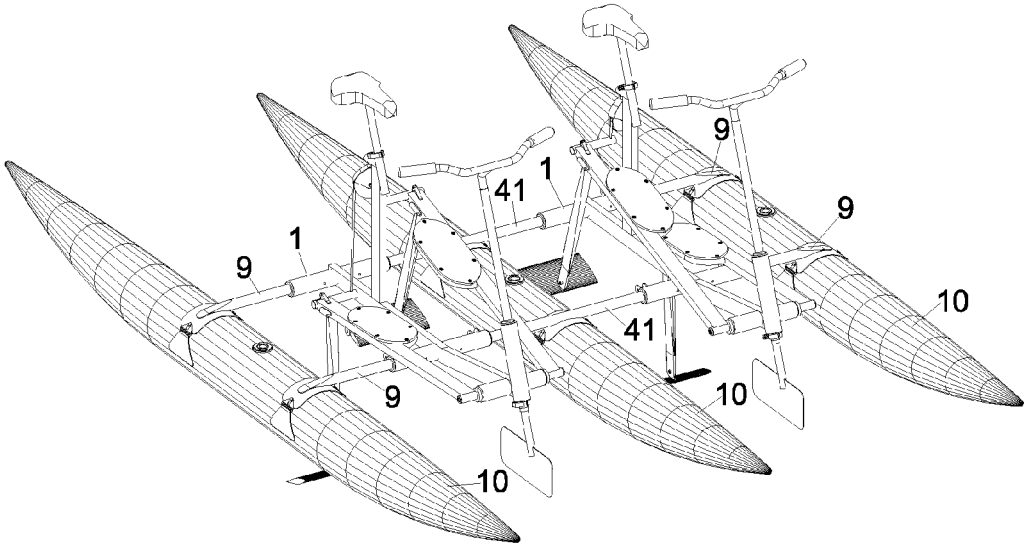
FIG. 19 is a perspective view of the trimaran configuration for two occupants according to a boat that can be converted into a gymnastics apparatus according to the present invention.

Two mainframes 1 can be joined side by side by two connecting bars 41. To perform the union, each connecting bar 41 is introduced as shown in FIG. 18 so that the groove 42 must be aligned with pins 23 present in the mainframe 1. After, each connecting bar 41 is rotated to the docking position on the float 10. In this position the grooves 42 are fitted on the pins 23, which restrict axial movement between the connecting bars 41 and the mainframes 1. With the engagement of the float 10, as shown in FIG. 19, the radial movement of the connecting bars 41 relative to the mainframes 1 is also constrained, thus fixing the parts in a simple and effective manner. So we have a trimaran boat for two occupants.

The invention claimed is:

1. Boat that can be converted into a gymnastics apparatus characterized by having a mainframe (1) on whose sides are mounted in an articulated manner, the sidebars (2) and (3), and in an intermediate position thereof is fixed the footrest (4) and in a rear position is fixed a propulsive rod (5), at the end of which is fixed a fin of flexible material or mounted a wing (6), which serve for propulsion, and a string (7) binds the sidebars (2) and (3), passing through the pulley (8) and four connecting bars (9) connect the mainframe (1) with the floats (10) which can be rigid or inflatable, and in the front of the mainframe (1) is mounted the steering tube (11) whose lower end is fixed rudder (12) and at the upper end of the steering shaft (11) is fixed a handlebar (13), which is thus linked to the rudder (12), allowing a driver to maneuver the boat while may be sitting on a seat (14) which is fixed to the mainframe (1).

2. Boat that can be converted into a gymnastics apparatus according to claim 1 characterized by being configured such that can be withdrawing its propulsive rod (5), the floats (10), the connecting bars (9), the rudder (12), and adding two dampers (15) so that one end is mounted in the sidebars (2) and (3) and the other on the mainframe (1), obtaining a step machine gymnastics apparatus that has a mode of linkage of sidebars (2) and (3), via a string (7) passing through a pulley (8) in a rear position distant from the hinge shaft (39), and for presenting a seat (14) which is fixed to the mainframe (1) in a region near the point of attachment of the pulley (8).

3. Boat that can be converted into a gymnastics apparatus according to claim 1 characterized by the connecting bars (9) having notches (22) allowing fitting to the pin (23) present on the mainframe (1) by the method of translatory movement followed by rotation restricting axial movement between the connecting bars (9) and mainframe (1), and after fitting the float (10), radial movement of the connecting bars (9) relative to the mainframe (1) is also restricted, setting parts.

4. Boat that can be converted into a gymnastics apparatus according to claim 1 characterized by having two propulsive rods (5) that are removable and interchangeable, one fixed to the rear end of the sidebar (2) and the other fixed to the rear end of the sidebar (3) and each propulsive rod (5) is manufactured from a tube that is mechanically formed, which has a hole on its bottom and a fitting plate (28, 35) on its top, and on its bottom one wing (6) is mounted on, which has limited freedom of rotation by the mounting bracket (29) which stops at the walls of the tube.

5. Boat that can be converted into a gymnastics apparatus according to claim 4 characterized by propulsive rods (5) that are fixed at the rear end of the sidebars (2) and (3) using a quick release mechanism (30) and a fitting plate (28) joined to the propulsive rod (5) so that the fitting plate (28) is fixed in three positions, in the two regions of contact with the pin (32) present in the sidebars (2) and (3) and in the region fixed by the quick release mechanism (30), so that these three positions define a triangle.

6. Boat that can be converted into a gymnastics apparatus according to claim 4 characterized by propulsive rods (5) that are fixed at the rear end of the sidebars (2) and (3) using the principle of wedge which is implemented by having two plates (33) and a threaded shaft (34) at the rear end of each sidebar (2) and (3) so that the notches (37) in the fitting plate (35), which is joined to the propulsive rod (5), stay positioned in wedges formed in the region between the plates (33) and the bottom wall of the sidebars (2) and (3) while the knob (36), having a internal conical region (38), is threaded to the threaded shaft (34) which engages and secures the back of fitting plate (35), which it is then fixed in three positions by the wedge principle and these three positions define a triangle.

7. Boat that can be converted into a gymnastics apparatus according to claim 1 characterized by presenting two mainframes (1) which are joined side by side by two connecting bars (41) which has a bracket in its intermediate position for engaging the float (10) and at its ends has grooves (42) allowing the fitting to the pin (23) present in the mainframe (1) by the method of translatory movement followed by rotation, restricting axial movement between the connecting bars (41) and the mainframe (1), and after fitting the float (10), the radial movement of the connecting bar (41) in relation to the mainframe (1) is also constrained, thus fixing the parts and obtaining, thereby, a trimaran boat for two occupants.

8. Boat that can be converted into a gymnastics apparatus according to claim 1 characterized by presenting a method to adjust the amplitude of movement of the footrest (4) by the adjustment of distance between the pulley (8) and its point of attachment to the mainframe (1).

9. Boat that can be converted into a gymnastics apparatus according to claim 1 characterized by the fact that the floats (10) are interchangeable, inflatable, having belts (26) fixed on its outer wall, which can assume two conditions:

a) when the floats (10) are in the semi-inflated condition, the buckles (24) can engage and disengage the hooks (25) present on the connecting bars (9, 41), and b) when the floats (10) are in the fully inflated condition, the buckles (24) remain attached to the hooks (25) present on the connecting bars (9, 41) which thus attaches the floats (10), thus the belts (26) are in a condition of permanent fraction.

* * * * *